US011754358B2

(12) United States Patent
Holland, II

(10) Patent No.: US 11,754,358 B2
(45) Date of Patent: Sep. 12, 2023

(54) ELECTRONICALLY CONTROLLED SAFETY SYSTEM FOR USE IN FIREARMS AND A METHOD FOR ITS USE

(71) Applicant: G. Thomas Holland, II, Baldwin City, KS (US)

(72) Inventor: G. Thomas Holland, II, Baldwin City, KS (US)

(73) Assignee: FREE STATE FIREARMS, LLC, Baldwin City, KS (US)

( * ) Notice: Subject to any disclaimer, the term of this patent is extended or adjusted under 35 U.S.C. 154(b) by 0 days.

(21) Appl. No.: 17/714,102

(22) Filed: Apr. 5, 2022

(65) Prior Publication Data

US 2022/0228830 A1 Jul. 21, 2022

Related U.S. Application Data

(63) Continuation-in-part of application No. 17/472,007, filed on Sep. 10, 2021.

(60) Provisional application No. 63/204,089, filed on Sep. 11, 2020.

(51) Int. Cl.
*F41A 17/06* (2006.01)
*F41A 17/46* (2006.01)

(52) U.S. Cl.
CPC ..... *F41A 17/063* (2013.01); *F41A 17/46* (2013.01)

(58) Field of Classification Search
CPC ..... F41A 17/066; F41A 17/46; F41A 17/063; F41A 17/06
See application file for complete search history.

(56) References Cited

U.S. PATENT DOCUMENTS

| | | | | |
|---|---|---|---|---|
| 3,553,877 A | | 1/1971 | Welch et al. | |
| 4,003,152 A | | 1/1977 | Barker et al. | |
| 4,467,545 A | | 8/1984 | Shaw, Jr. | |
| 4,970,819 A | | 11/1990 | Mayhak | |
| 5,168,114 A | | 12/1992 | Enget | |
| 5,307,053 A | * | 4/1994 | Wills | G08B 21/0263 340/8.1 |
| 5,423,143 A | | 6/1995 | Martin | |
| 5,448,847 A | | 9/1995 | Teetzel | |

(Continued)

FOREIGN PATENT DOCUMENTS

WO WO2014142921 A1 9/2014

*Primary Examiner* — Joshua E Freeman
(74) *Attorney, Agent, or Firm* — MUSKIN & FARMER, LLC

(57) ABSTRACT

The present device is an electronically controlled safety system for use in firearms comprising a shape memory actuator configured to connect a mechanical locking interface to a trigger mechanism interface comprising a point of connection to a firearm's trigger mechanism. This shape memory actuator can be controlled by use of an authentication system comprising an RFID module and a control module. The user of the firearm can provide authorization to place the firearm in the armed position by placing an RFID tag having a certain activation code near the RFID module, which can then activate the shape memory actuator through the control module. When the mechanical locking interface is connected to the trigger mechanism interface a firearm's trigger mechanism is locked in place and the firearm is in a safe position and when it is not connected to the trigger mechanism it is in an armed position.

20 Claims, 14 Drawing Sheets

(56) References Cited

U.S. PATENT DOCUMENTS 5,704,151 A * 1/1998 West ..... F41A 17/06 42/70.07
5,704,153 A 1/1998 Kaminski et al.
5,755,056 A 5/1998 Danner et al.
6,237,271 B1 5/2001 Kaminski
6,286,242 B1 9/2001 Klebes
6,321,478 B1 11/2001 Klebes
6,357,156 B1 3/2002 Klebes et al.
6,357,157 B1 3/2002 Constant et al.
6,360,468 B1 3/2002 Constant et al.
6,412,207 B1 * 7/2002 Crye ..... F41A 17/56 42/70.08
6,523,296 B1 2/2003 Constant et al.
7,568,302 B1 * 8/2009 Bubits ..... F41A 17/56 42/70.11
8,893,420 B2 11/2014 Milde, Jr. et al.
8,966,797 B2 3/2015 Carlson
9,341,425 B2 * 5/2016 Carlson ..... F41A 19/10
9,651,325 B1 * 5/2017 Gant ..... F41C 23/16
9,857,133 B1 * 1/2018 Kloepfer ..... G06F 21/32
2006/0080881 A1 * 4/2006 Cuprin ..... F41A 17/066 42/70.02
2009/0007476 A1 * 1/2009 Mauch ..... F41A 17/063 73/488
2011/0061280 A1 * 3/2011 Emde ..... F41A 17/063 42/70.01
2012/0151814 A1 6/2012 Dietel
2013/0019512 A1 1/2013 Kemmerer et al.
2015/0377574 A1 * 12/2015 Cooke ..... F41A 17/56 42/70.11
2016/0054083 A1 * 2/2016 Kiyani ..... F41A 17/066 42/70.11
2016/0252317 A1 * 9/2016 Biran ..... F41A 17/066 42/1.01
2017/0146309 A1 * 5/2017 Biran ..... F41A 17/38
2017/0350667 A1 * 12/2017 Fishbein ..... F41A 17/063
2021/0185138 A1 * 6/2021 Gant ..... F41A 17/063
2022/0178639 A1 * 6/2022 Song ..... F41A 17/46

* cited by examiner

Electrical Circuit Flow Chart

ELECTRONICALLY CONTROLLED SAFETY SYSTEM FOR USE IN FIREARMS AND A METHOD FOR ITS USE

CROSS-REFERENCE TO RELATED APPLICATIONS

This application is a continuation-in-part of nonprovisional patent application Ser. No. 17/472,007 filed Sep. 10, 2021, which claims benefit to provisional application Ser. No. 63/204,089, filed Sep. 11, 2020, both of which are incorporated by reference herein in their entireties.

FIELD OF THE INVENTION

The present apparatus relates to electronically controlled trigger locking mechanisms for use in firearms to enhance both safety and function.

BACKGROUND

There exists a great deal of prior art relating to electronically controlled firearms, wherein electronics are incorporated into the firearm for various purposes. Many of these references disclose electronic firearms designed to enhance the safety of the firearm by aiming to prevent unauthorized users from discharging the firearm through use of an electronically controlled trigger locking mechanism. Unfortunately, many of these devices contain inherent flaws allowing them to be defeated by tampering. For example, some such devices comprise solenoids which can often be overcome simply by using a magnet.

In other such systems, the authentication step, such as the use of fingerprint scanners, but such systems are also flawed. Specifically, scanning a finger can take time that is not available and can malfunction if they become dirty or scratched or if a user's finger becomes dirty or injured.

What is needed is an electronically controlled trigger locking mechanism, with RFID tag authentication, that can quickly and reliably function when operated properly and cannot be easily overridden or otherwise compromised through the use of simple and widely available devices such as magnets.

SUMMARY OF THE INVENTION

It is an aspect of the present inventive concept to provide an electronically controlled safety system for use in firearms comprising: a trigger mechanism interface connected to, or otherwise incorporated into a firearm's trigger mechanism wherein the trigger mechanism interface comprises a point of connection; a shape memory actuator module comprising at least one shape memory wire and a mechanical locking interface actuated by at least one shape memory wire wherein the mechanical locking interface is designed to connect to the point of connection of the trigger mechanism interface and immobilize the trigger mechanism when the mechanical locking interface is connected to the point of connection of the trigger mechanism interface; a radio frequency identification module comprising a radio frequency identification reader configured to send a radio frequency interrogation signal and to receive a predetermined activation code; a radio frequency identification tag configured to transmit the certain predetermined activation code when subjected to the radio frequency identification reader's interrogation signal received at or above a predetermined signal strength; a control module configured to allow a current to flow to the shape memory actuator module when the radio frequency identification reader receives the predetermined activation code; and a magazine and battery module configured to provide an electrical current to the shape memory actuator module, the radio frequency identification module, and the control module wherein the control module is configured to activate a vibration motor when the firearm is armed and ready to fire.

It is also an aspect of the present inventive concept to provide a method for using an ECSS-equipped firearm, the method comprising: providing an ECSS-equipped firearm comprising a trigger mechanism interface connected to, or otherwise incorporated into a firearm's trigger mechanism wherein the trigger mechanism interface comprises a point of connection; a shape memory actuator module comprising at least one shape memory wire and a mechanical locking interface actuated by at least one shape memory wire wherein the mechanical locking interface is designed to connect to the point of connection of the trigger mechanism interface and immobilize the trigger mechanism when the mechanical locking interface is connected to the point of connection of the trigger mechanism interface; a radio frequency identification module comprising a radio frequency identification reader configured to send a radio frequency interrogation signal and to receive a predetermined activation code; a radio frequency identification tag configured to transmit the certain predetermined activation code when subjected to the radio frequency identification reader's interrogation signal received at or above a predetermined signal strength; a control module configured to allow a current to flow to the shape memory actuator module when the radio frequency identification reader receives the predetermined activation code; and a magazine and battery module configured to provide an electrical current to the shape memory actuator module, the radio frequency identification module, and the control module wherein the control module measures battery voltage of the magazine and battery module to determine if it is within a predetermined range suitable for operation and wherein the control module is configured to activate a vibration motor when the firearm is armed and ready to fire; providing at least one round of suitable ammunition; placing the at least one round of suitable ammunition in the magazine; placing the magazine in the magazine well and chambering the at least one round of suitable ammunition; placing the radio frequency identification tag near the ECSS-equipped firearm; and pulling the trigger of the ECSS-equipped firearm.

These together with other aspects and advantages which will become apparent, reside in the details of construction and operation as more fully hereinafter described and claimed, reference being had to the accompanying drawings forming a part thereof, wherein like numerals refer to like parts throughout.

BRIEF DESCRIPTION OF THE DRAWINGS

Further features and advantages of the present device, as well as the structure and operation of various embodiments of the present device, will become apparent and more readily appreciated from the following description of the preferred embodiments, taken in conjunction with the accompanying drawings of which.

DETAILED DESCRIPTION

Figure 1:
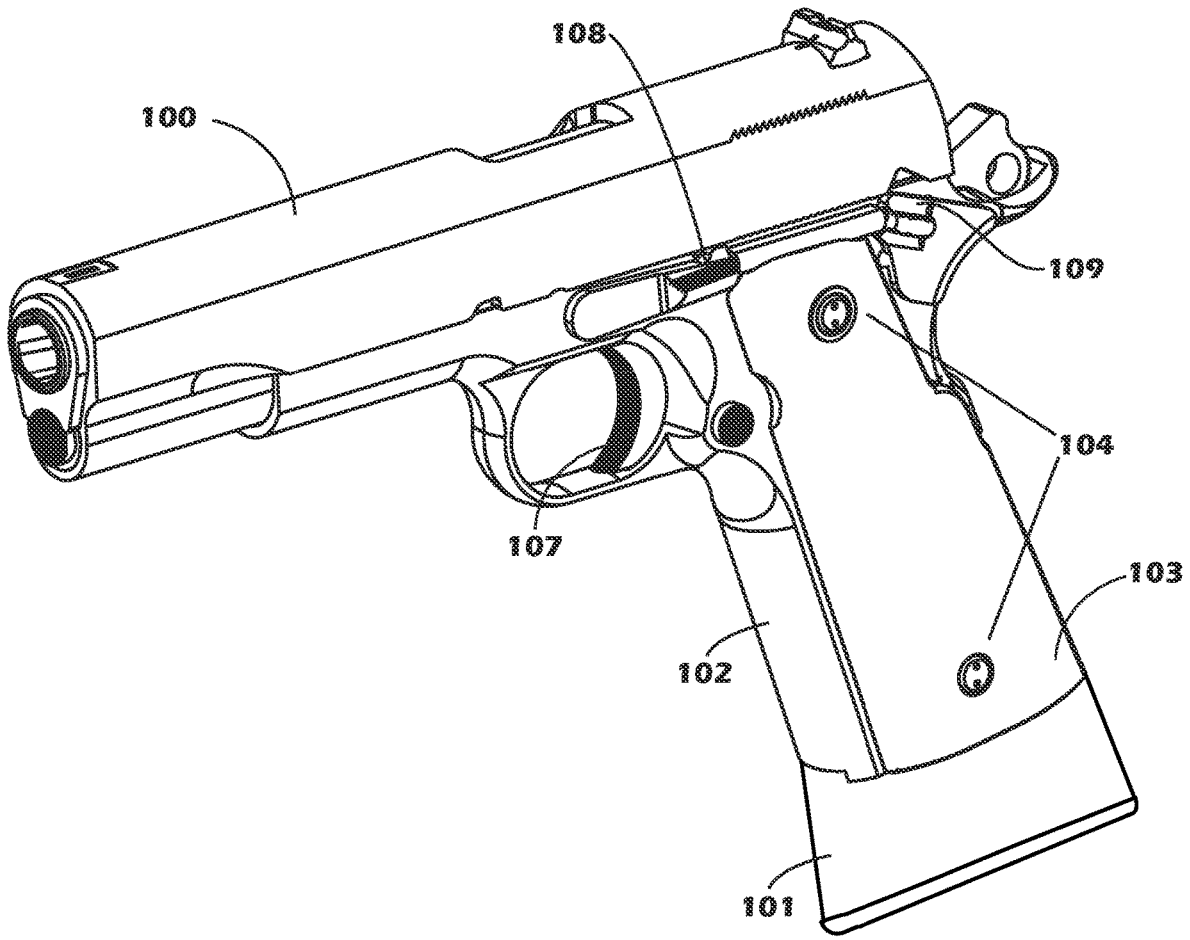
FIG. 1 is a front, top, and left side perspective view of a semiautomatic handgun comprising an electronically controlled safety system (ECSS), hereinafter referred to as an "ECSS-equipped firearm," according to an embodiment.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

The present ECSS is shown as an integrated system comprising a fully functional ECSS-equipped, semiautomatic handgun. However, the present device could be made compatible for use with almost any type of firearm comprising a handle in close proximity to built-in trigger and safety mechanisms, which includes the vast majority of firearms. Therefore, minor modifications to the ECSS disclosed below could allow for use of the present system and method in a wide variety of handguns, rifles, stun guns, shoulder-fired missile launchers, and shotguns just to name a few examples.

According to an embodiment, the present ECSS can provide a firearm safety mechanism comprising a radio frequency identification (RFID) module working in conjunction with a shape memory actuator (SMA) module to prevent the accidental or unauthorized discharge of an ECSS-equipped firearm. Specifically, the present ECSS can prevent the equipped firearm from discharging if a radio identification tag ("RFID tag"), which can be configured to transmit a signal comprising a unique data set, is not held in close proximity to the RFID module, which can comprise an RFID reader. According to an embodiment, the customized RFID tag can be incorporated into a glove, ring, bracelet or any other object worn or otherwise connected to an authorized user's hand and capable of comprising an RFID tag. Additionally, if so desired, further predetermined limiting conditions can be required to be present before ECSS-equipped firearm can be allowed to discharge.

The present ECSS can be integrated as original equipment of the manufacturer (OEM) or it can be provided as an aftermarket device to be installed on existing firearms, which can require modifications to the frame or other parts of the firearm. In the embodiment of an ECSS-equipped firearm as depicted in the figures, nearly all of the components are housed within the left and right grip panels, which can be removable, and thus, replaceable with the ECSS-comprising substitute panels.

The SMA comprising the SMA module can be customized to be compatible with firearms comprising any type of mechanical trigger mechanism. Such SMA's can comprise a wire made of an alloy, such as Nitinol, which can change shape and shrink when a current is applied to it. Such devices have many advantages over actuators such as solenoids, because of their power relative to their size and weight along with their speed and reliability. Also, such devices are immune to tampering with magnets which is a particular, and well-known vulnerability of solenoids.

FIG. 1 is a front, top, and side perspective view of an ECSS-equipped firearm 100, according to an embodiment. This figure shows the aesthetic differences between the ECSS-equipped firearm 100 and a standard semiautomatic handgun, which are few, with the most notable difference being the magazine and battery pack module 101 located below the pistol grip 102 according to this embodiment. In the embodiment shown, nearly all of the other components comprising the ECSS can be housed within the grip panels, making them nearly imperceptible without disassembling the firearm. FIG. 1 shows the left grip panel 103, which can house an SMA module (not visible in FIG. 1) according to an embodiment. As an additional safety feature, the grip panels, such as the left grip panel 103, can be held in place with tamper resistant fasteners 104, which can require a special tool (not shown) to remove, according to an embodiment. Other parts, remain identical to those which can be found on a standard firearm, such as a trigger 107 and one or more manual safeties 108 and 109, which can remain fully operational as additional safety devices comprising an ECSS-equipped firearm 100, according to an embodiment.

Figure 2:
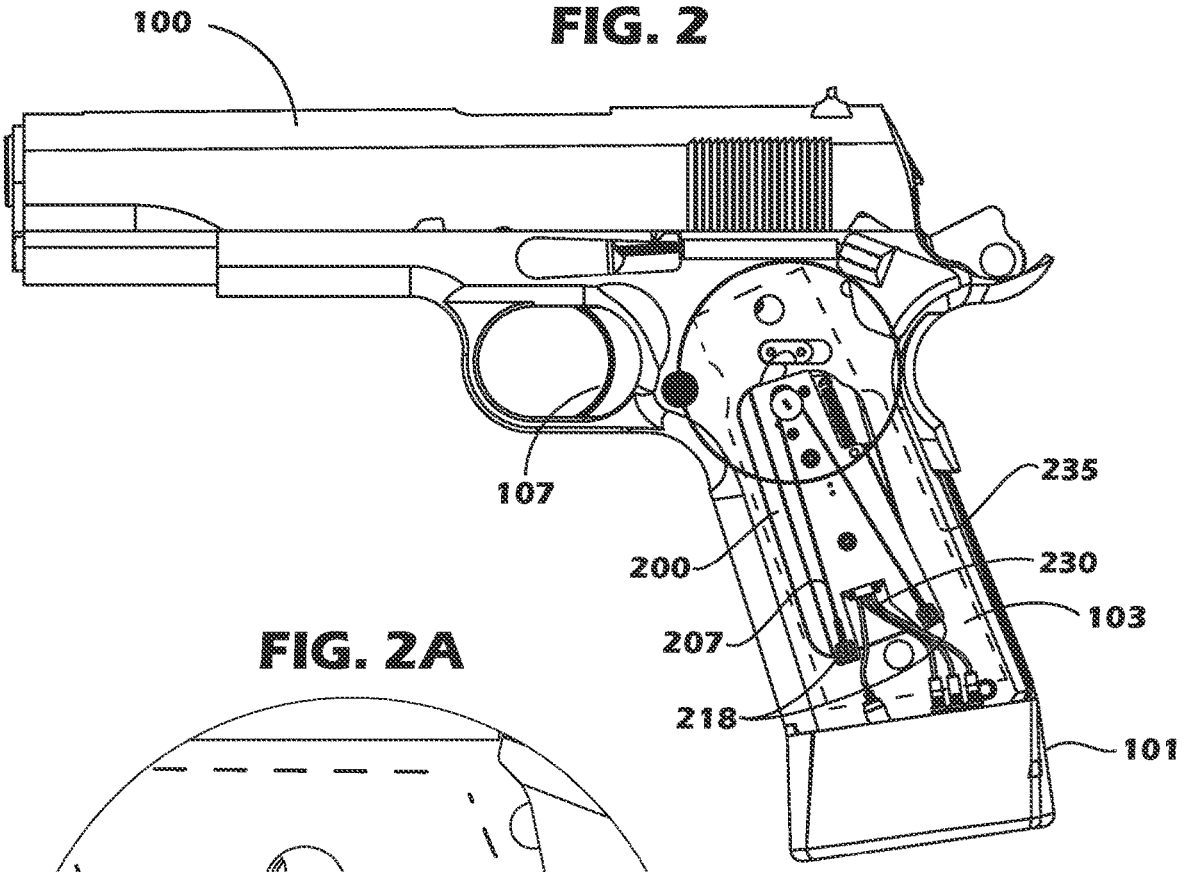
FIG. 2 is a side view of the ECSS-equipped firearm, as shown in FIG. 1, comprising a partially transparent view of the outer side of the left grip panel showing the relative size and position of a shape memory actuator (SMA) module housed within the left grip panel, according to an embodiment.

FIG. 2 is a side view of the ECSS-equipped firearm 100 as shown in FIG. 1, comprising a partially transparent view of an outer side 235 of the left grip panel 103 showing the relative size and position of a shape memory actuator (SMA) module 200 housed within the left grip panel 103, according to an embodiment. This view also shows how electrical signals and current can be provided to the SMA module 200 from the magazine and battery pack module 101 through wiring 230 connecting the SMA module 200 to the magazine and battery pack module 101, according to an embodiment.

Figure 2A:
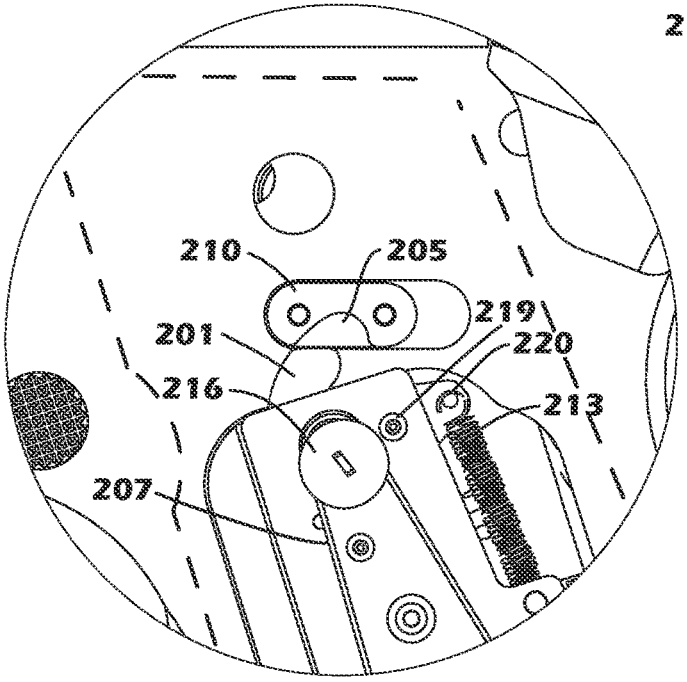
FIG. 2A is a magnified partial side view of the top portion of the outer side of the left grip panel, housing the top portion of the SMA module shown in FIG. 2, according to an embodiment.

FIG. 2A is a magnified partial side view of a top portion of the outer side 235 of the left grip panel 103, housing the top portion of the SMA module 200 shown in FIG. 2. In this view, the relative size and location of the moving parts comprising the SMA module 200 can be more fully understood, according to an embodiment. In this particular embodiment, the SMA module 200, which is a type of electronically controlled trigger locking mechanism, can comprise a stage 201, which is only partially visible in FIGS. 2 and 2A, capable of moving up and down in a radial motion. A portion of this stage 201 can be moved into a notch 205 located in, or comprising, a shuttle 210 for this particular firearm. In the embodiment shown in the figures, and described herein, the shuttle 210 can be connected to a firearm's trigger mechanism and can be configured to move in concert with the trigger 107. Therefore, if the shuttle 210 can move freely, then the trigger 107 can also move freely and if the shuttle 210 is prevented from moving, then the trigger 107 can also be prevented from moving, according to an embodiment.

Note that the shuttle 210 is used in this disclosure for illustrative purposes in order to describe the main components and functionality of the present ECSS, but the described shuttle 210 is just one type of trigger mechanism interface allowing the SMA module 200 to connect to a firearm's trigger mechanism. Some firearms may not require any such part be added to its trigger mechanism in order to create a suitable trigger mechanism interface, whereas other firearms may require an added feature, such as the shuttle 210, but in a different size and shape. The key is that as suitable trigger mechanism interface must allow the moving parts of an SMA module 200 to interact with a firearm's trigger mechanism in order to move it from an armed position to a safe position and vice versa as the shuttle 210 and stage 201 interact as demonstrated in the present embodiment. Similarly, the notch 205 is only an example of a point of connection which can be part of a firearm's trigger mechanism interface wherein the SMA module 200 connects or otherwise contacts the firearm's trigger mechanism. Additionally, the stage 201 is used in this disclosure for illustrative purposes in order to describe a mechanical locking interface as a particular component of the SMA module 200. The particular shape and movement of the stage 201 described and shown in the figures are specific to the requirements of the handgun used to illustrate the present ECSS. However, other firearms may use a different mechanical locking interface comprising a different shape and movement. The requirement of a mechanical locking interface is that it be capable of connecting to the trigger mechanism interface at a particular point of connection so as to allow the SMA module 200 to interact with a firearm's trigger mechanism in order to move it from an armed position to a safe position and vice versa as the stage 201 and shuttle 210 are capable of in the embodiment described herein and shown in the figures.

In the embodiment shown in FIGS. 2 and 2A, the shuttle 210 can be locked in place when a portion of the stage 201 is inserted into the notch 205 of the shuttle 210, thus locking the trigger mechanism, and the trigger 107 in place and preventing the ECSS-equipped firearm 100 from being able to fire. In FIGS. 2 and 2A, no portion of the stage 201 is inserted into the shuttle 210, and therefore, the shuttle 210 and the trigger 107 can be free to move and the ECSS-equipped firearm 100 can be ready to fire, according to an embodiment.

While the lever mechanism features of the stage 201 are not fully visible in FIGS. 2 and 2A, the shape memory wire 207 as well as a turnaround 216, which is immovably connected to the stage 201, are visible in these figures. According to an embodiment, the shape memory wire 207 can exert force on the stage 201. According to an embodiment, the stage 201 can function as a lever, capable of rotating around a fulcrum 219 with a spring 213 pulling down on a first side 220 and the shape memory wire 207 configured to exert downward force on a second side (not visible) through the turnaround 216 as the shape memory wire 207 is shortened when subjected to an electrical current. Specifically, the shape memory wire 207 can be immovably mounted onto the SMA module 200 at two anchor points 218 while the turnaround 216 can remain capable of being moved up and down, according to an embodiment. Therefore, when a current is applied to the shape memory wire 207, it contracts pulling the turnaround 216 and the second side (not visible in FIGS. 2 and 2A) of the stage 201 downward, which can rotate the stage 201 into the armed position, wherein no portion of the stage 201 is located in the notch 205 of the shuttle 210. However, when no current is applied to the shape memory wire 207, it returns to its uncontracted length and the spring 213 can pull the first side 220 of the stage 201 downward, causing the second side (not visible) of the stage 201 and the turnaround 216 to move upward, thus moving the stage 201 into the notch 205 of the shuttle 210, which is the safe position, according to an embodiment.

Figure 3A:
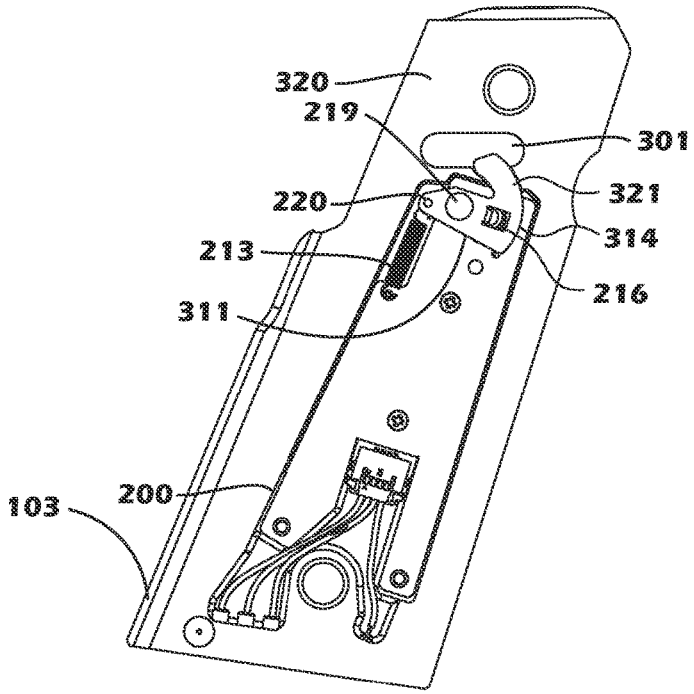
FIG. 3A is a top, front, and side view of an inner side of a left grip panel comprising the SMA module in a safe position, according to an embodiment.
Figure 3B:
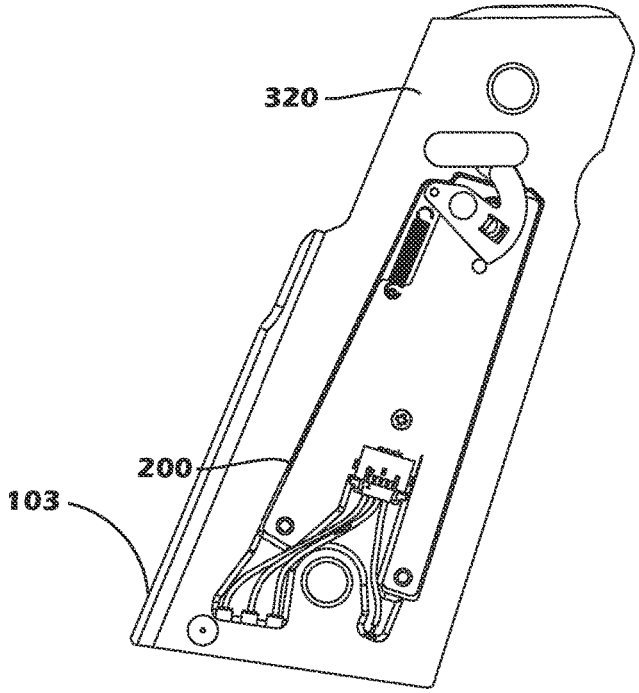
FIG. 3B is a top, front, and side view of the inner side of a left grip panel comprising the SMA module in an armed position, according to an embodiment.

FIG. 3A is a top, front, and side view of the inner side 320 of the left grip panel 103 comprising the SMA module 200 in a safe position and FIG. 3B is a top, front, and side view of the inner side 320 of the left grip panel 103 comprising the SMA module 200 in an armed position, according to an embodiment. The inner side 320 of the left grip panel 103 can be the side closest to the pistol grip 102 of the ECSS-equipped firearm 100, and this inner side 320 would not be visible to a user when installed onto the pistol grip 102 of the ECSS-equipped firearm 100, neither of which are shown in FIGS. 3A and 3B. According to the embodiment described for the present ECSS-equipped firearm 100, a channel 301 can be cut into the inner side 320 of the left grip panel 103 allowing access to the shuttle 210 (not visible in FIG. 3A) by the stage 201 (not shown in FIGS. 3A and 3B). In the embodiment shown, the shuttle 210 (not visible in FIG. 3A) can be connected to the trigger mechanism (not visible in FIG. 3A) and can also protrude outward into the plane of the inner side 320 of the left grip panel 103 and into the channel 301. This protrusion allows the stage 201 to have access to the shuttle 210, and particularly, to the notch 205 (neither of which are visible in FIG. 3A) because both the shuttle 210 and the notch 205 are in the same vertical plane as the stage 201, according to an embodiment.

In the embodiment shown in FIGS. 3A and 3B, the stage 201 can almost be seen in its entirety allowing its function as a lever to be more fully understood. Specifically, the stage 201 can be designed to move between a safe position (shown in FIG. 3A) and an armed position (shown FIG. 3B) and move between the two positions by pivoting about the fulcrum 219. In this embodiment, the front end 220 of a straight lower section 311 can be connected to the spring 213 and the back end 314 of the straight lower section 311 can be connected to both the turnaround 216 (only partially visible in FIGS. 3A and 3B) and the curved upper section 321. Note that many of the parts shown in FIGS. 3A and 3B are shown on one side in FIGS. 2 and 2A and on the other side in FIGS. 3A and 3B.

The curved upper section 321 can comprise the curved shape in order to allow the stage 201, and specifically the curved upper section 321, to center itself into the notch 205 of the shuttle 210 (neither of which are shown in FIGS. 3A and 3B) while also maximizing surface engagement between the stage 201 and the shuttle 210. Also note that each of the sections comprising the stage 201 can be individual pieces connected together or can all be part of a single piece, as shown in FIGS. 3A and 3B, of suitable material such as metal or plastic.

According to an embodiment, and as discussed above, the stage 201 can be connected to a shape memory wire 207 (not shown in FIGS. 3A and 3B) designed to shorten when an electrical current is applied to it. According to an embodiment, the shape memory wire 207 can be comprised of Nitinol or a similar material capable of moving between a contracted state when an electrical current is applied to it and a relaxed state, when an electrical current is not applied to it. As the curved upper section 321 is connected to, or otherwise attached to the back end 314 of the straight lower section 311, it moves as the back end 314 moves. In this embodiment, the curved upper section 321 can be actuated radially upward into the safe position by the spring 213 when the shape memory wire 207 is in the relaxed state and thus does not exert any force on the stage 201 through the turnaround 216. Similarly, the curved upper section 321 can be actuated radially downward into the armed position, as shown in FIG. 3B, when the shape memory wire 207 is contracted, or shortened, applying force on the stage 201 through the turnaround 216, according to an embodiment. In short, the spring 213 pulls the front end 220 of the straight lower section 311 down, resulting in the curved upper section 321 moving upward into the safe position unless the shape memory wire 207 counteracts the downward pull of the spring 213 on the front end 312 of the straight lower section 311 by pulling the front end 312 of the straight lower section 311 downward resulting in the curved upper section 321 moving into the armed position as shown in FIG. 3B. In other words, according to an embodiment, the safe position, as shown in FIG. 3A, can be the default position and the ECSS-equipped firearm 100 can only position the stage 201 into the armed position when a predetermined set of conditions have been satisfied allowing an electrical current to flow to the SMA module 200 and for the shape memory wire 207 to be contracted.

Figure 4A:
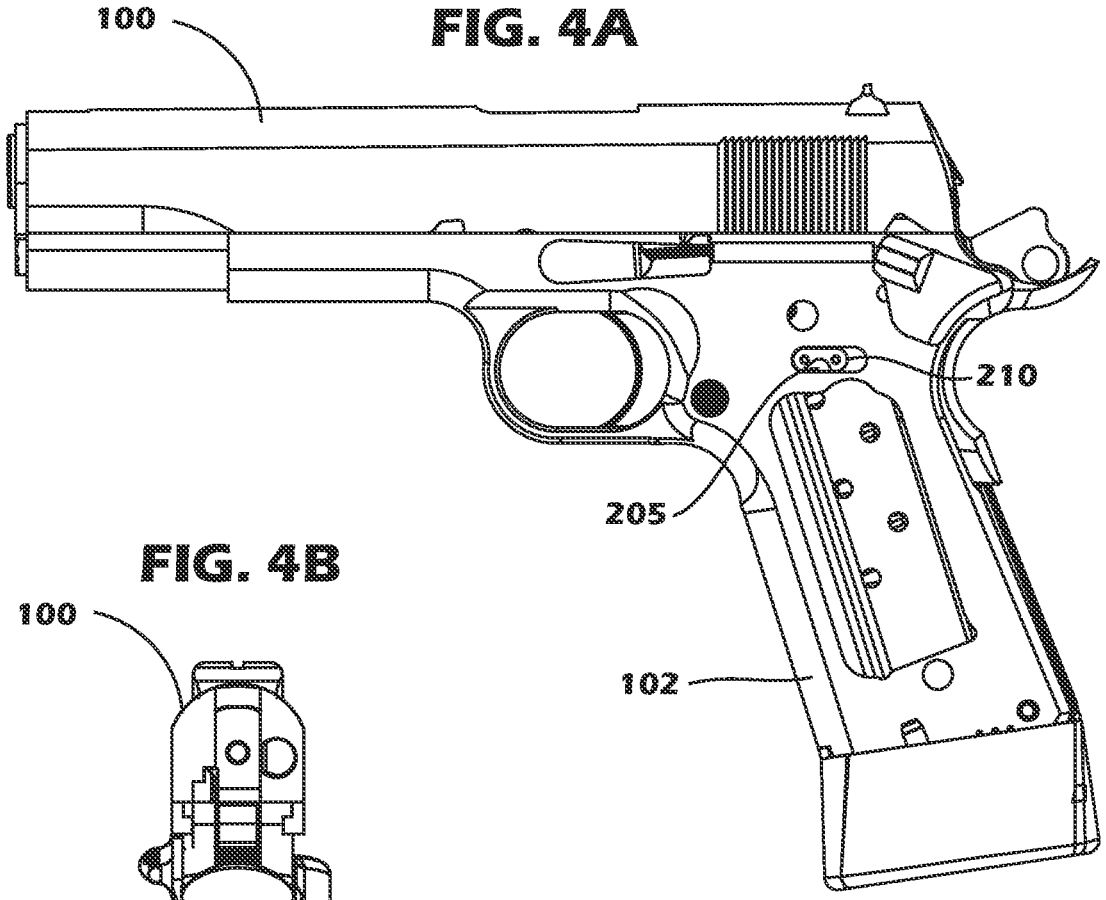
FIG. 4A is a side view of an ECSS-equipped firearm, with the left grip panel completely removed showing part of a trigger mechanism interface, according to an embodiment.
Figure 4B:
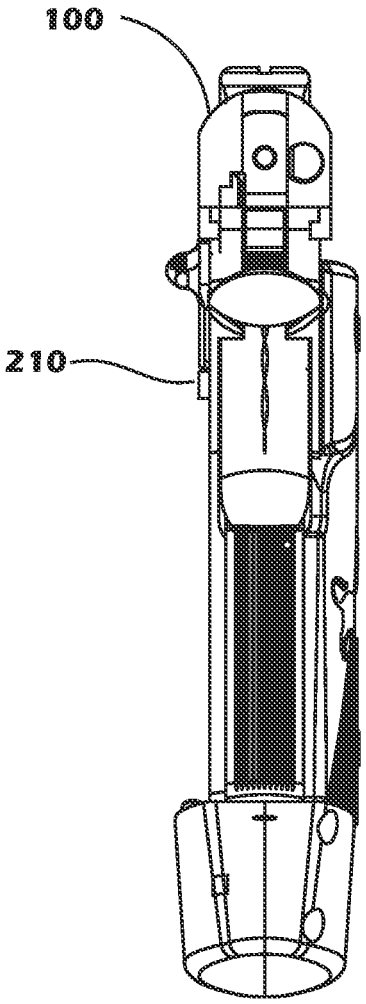
FIG. 4B is a rear view of an ECSS-equipped firearm, with the left grip panel completely removed showing part of a trigger mechanism interface, according to an embodiment.

FIG. 4A is a side view and FIG. 4B is a rear view of an ECSS-equipped firearm 100 wherein the left grip panel 103 (not shown in FIG. 4A or 4B) comprising the SMA module 200 (not shown in FIG. 4A or 4B) has been removed, showing the pistol grip 102 beneath the left grip panel 103, according to an embodiment. This view shows the position and of the shuttle 210 in this embodiment from two angles. FIG. 4B shows how the shuttle 210 protrudes out of the pistol grip 102 and would fit within the channel 301 discussed in FIGS. 3A and 3B, but not shown in FIG. 4A or 4B. As discussed, this protrusion places the shuttle 210 into the same vertical plane as the stage 201 (not shown in FIGS. 4A and 4B) allowing the curved upper section 321 of the stage 201 to access the notch 205 of the shuttle 210, according to an embodiment.

Figure 5:
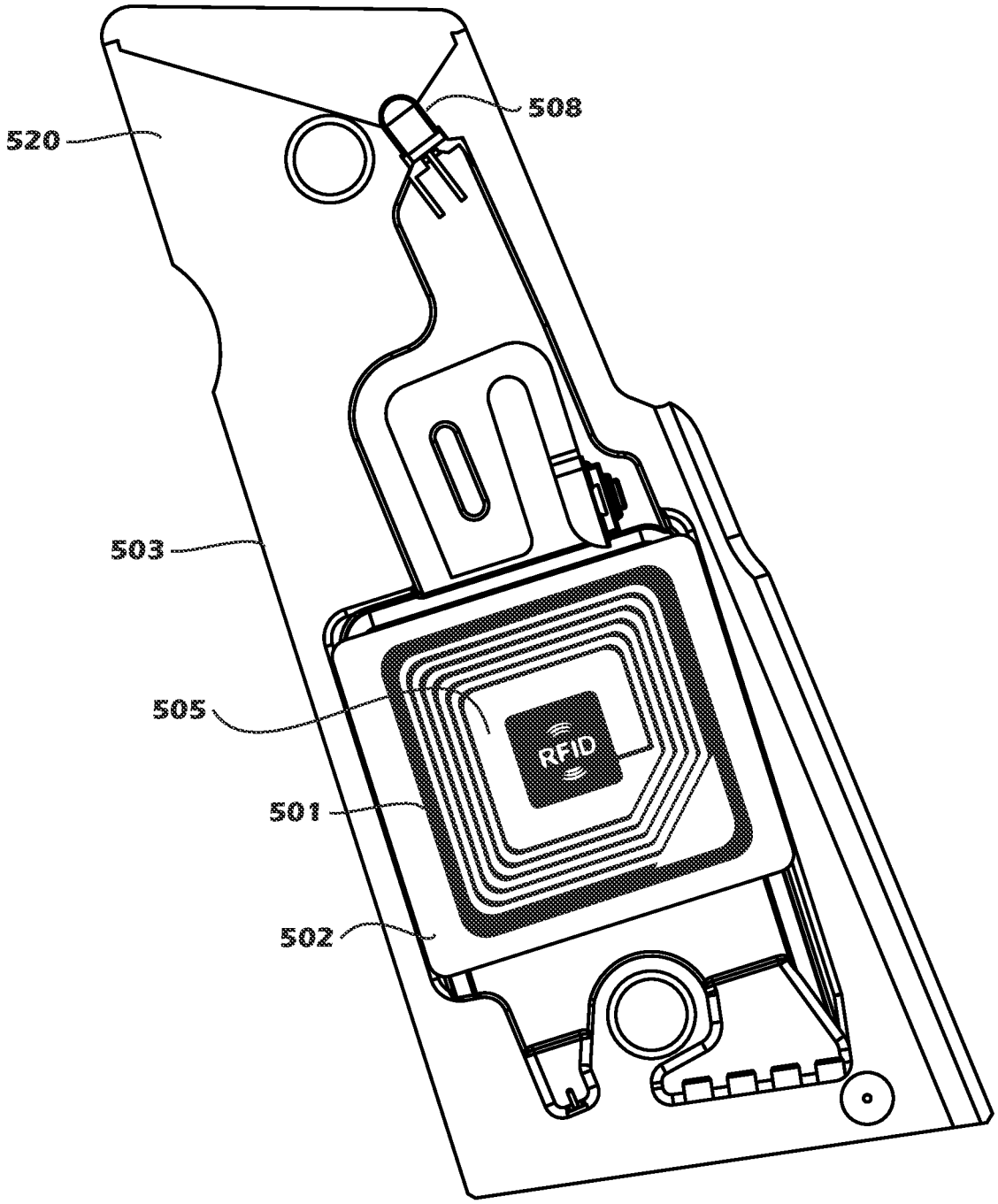
FIG. 5 is a side view of an inner side of a right grip panel wherein an RFID module and a control module comprising an ECSS can be housed, according to an embodiment.

FIG. 5 is a side view of an inner side 520 of a right grip panel 503 wherein an RFID module 501 and a control module 502 comprising an ECSS can be housed, according to an embodiment. An embodiment of the present ECSS-equipped firearm 100 can comprise an RFID module 501 comprising an antenna 505, which can be 13.56 MHz configured to receive a signal from a paired RFID tag (not shown in FIG. 5) placed in close proximity to the antenna 505. According to an embodiment, the right grip panel 503 can also comprise a control module 502, which can be programmed to compare the embedded code, also known as the RFID tag number, received by the RFID reader comprising the RFID module 501 from the RFID tag. According to an embodiment, the control module 502 can be preprogrammed to allow current to flow to the SMA module 200 after the RFID module 501 reads a RFID tag number preprogrammed into the control module 502. It can be undesirable for the RFID module 501 to have a range of more than twelve inches as this may allow the firearm to be used by someone other than the authorized user if, for example, the RFID tag is in the same room as the ECSS-equipped firearm 100 but the user is not holding the ECSS-equipped firearm 100. According to an embodiment, an indicator light 508 or other sensory device can be incorporated into the right grip panel 503 to notify the user of that the firearm is in the armed position and ready to fire, to indicate battery level or to convey any other information regarding the status of the ECSS-equipped firearm 100. According to an embodiment, the sensor light can either be augmented or entirely replaced by a vibration motor (not shown in FIG. 5) or other form of haptic feedback device as the illumination of sensor lights on or near a firearm may be undesirable in certain circumstances.

Figure 6:
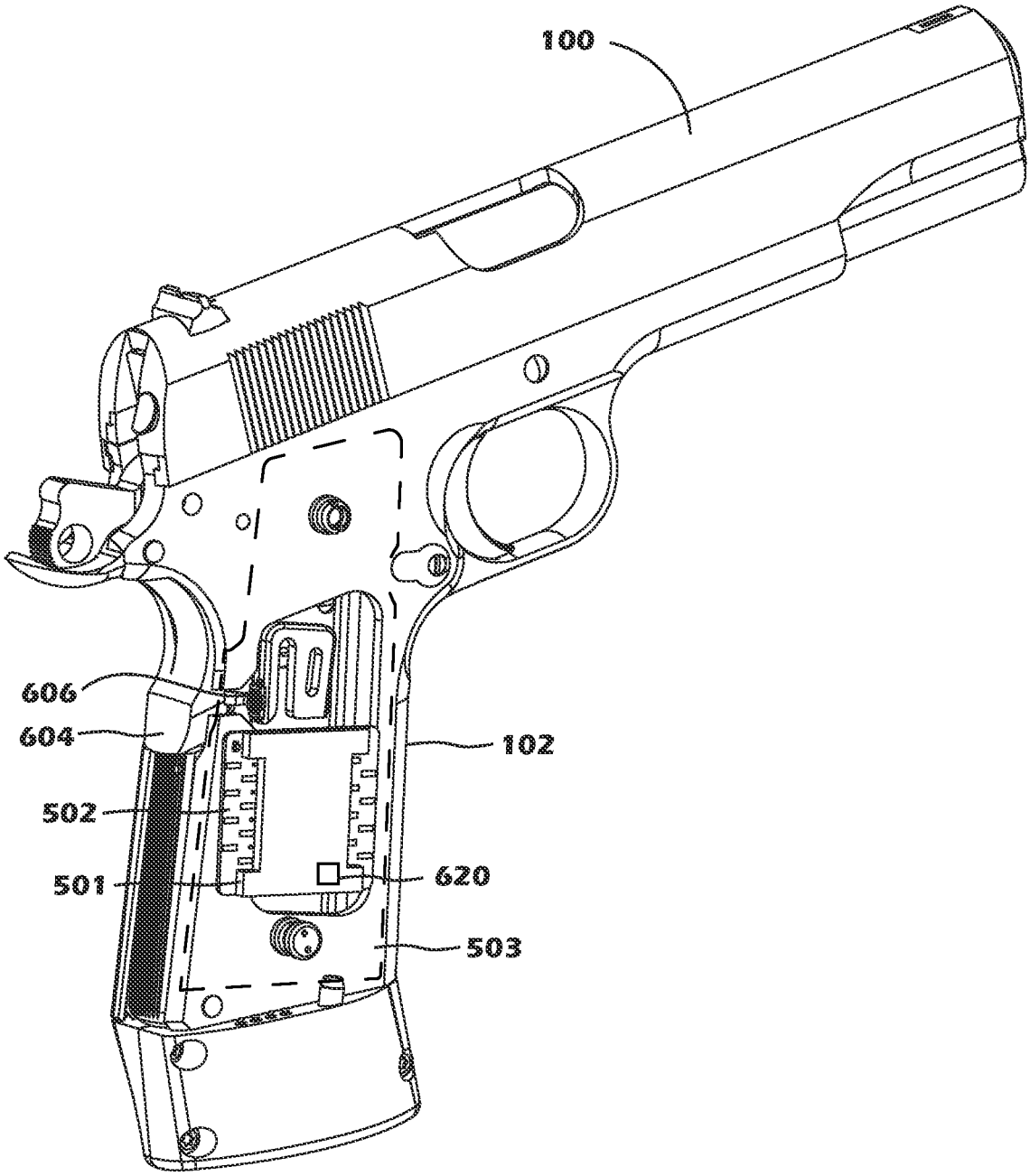
FIG. 6 is a partially transparent top, rear, and side view of the right side of a pistol grip panel connected to a pistol grip wherein an RFID module, a vibration motor, and a control module comprising an ECSS have been mounted, according to an embodiment.

FIG. 6 is partially transparent top, rear, and side view of the right grip panel 503 connected to a pistol grip 102 wherein an RFID module 501 and a control module 502 comprising an ECSS-equipped firearm 100 have been mounted, according to an embodiment. The embodiment shown in FIG. 6 comprises a grip safety 604, which can be configured to depress a presence switch 606 when the pistol grip 102 is firmly held by a user. In some embodiments, electric current will not flow to the SMA module 200 unless or until the presence switch 606 is depressed. In a preferred embodiment, an ECSS-equipped firearm 100, could also comprise other mechanical safeties, such as the grip safety 604 and the one or more manual safeties 108 and 109 as shown in FIG. 1, can remain functional in addition to the safety features provided by the ECSS. As discussed above, according to an embodiment, the ECSS may comprise a vibration motor 620, which can be used to provide haptic feedback to the user. Specifically, the vibration motor may vibrate when the firearm is armed and ready to fire, to indicate battery level or to convey any other information regarding the status of the ECSS-equipped firearm 100.

Additionally, if used to indicate battery level, an ECSS-equipped firearm 100 can vibrate at a first frequency to indicate that the measured battery voltage of the magazine and battery module is lower than the predetermined range suitable for operation and vibrate at a second frequency to indicate that the measured battery voltage of the magazine and battery module is suitable for operation, but is at lower end of the predetermined range suitable for operation. According to an embodiment, all vibrations created by the vibration motor, for any purpose, can be calibrated and adjusted to be optimally sensed by a user's hand as he or she holds the ECSS-equipped firearm 100.

Figure 7:
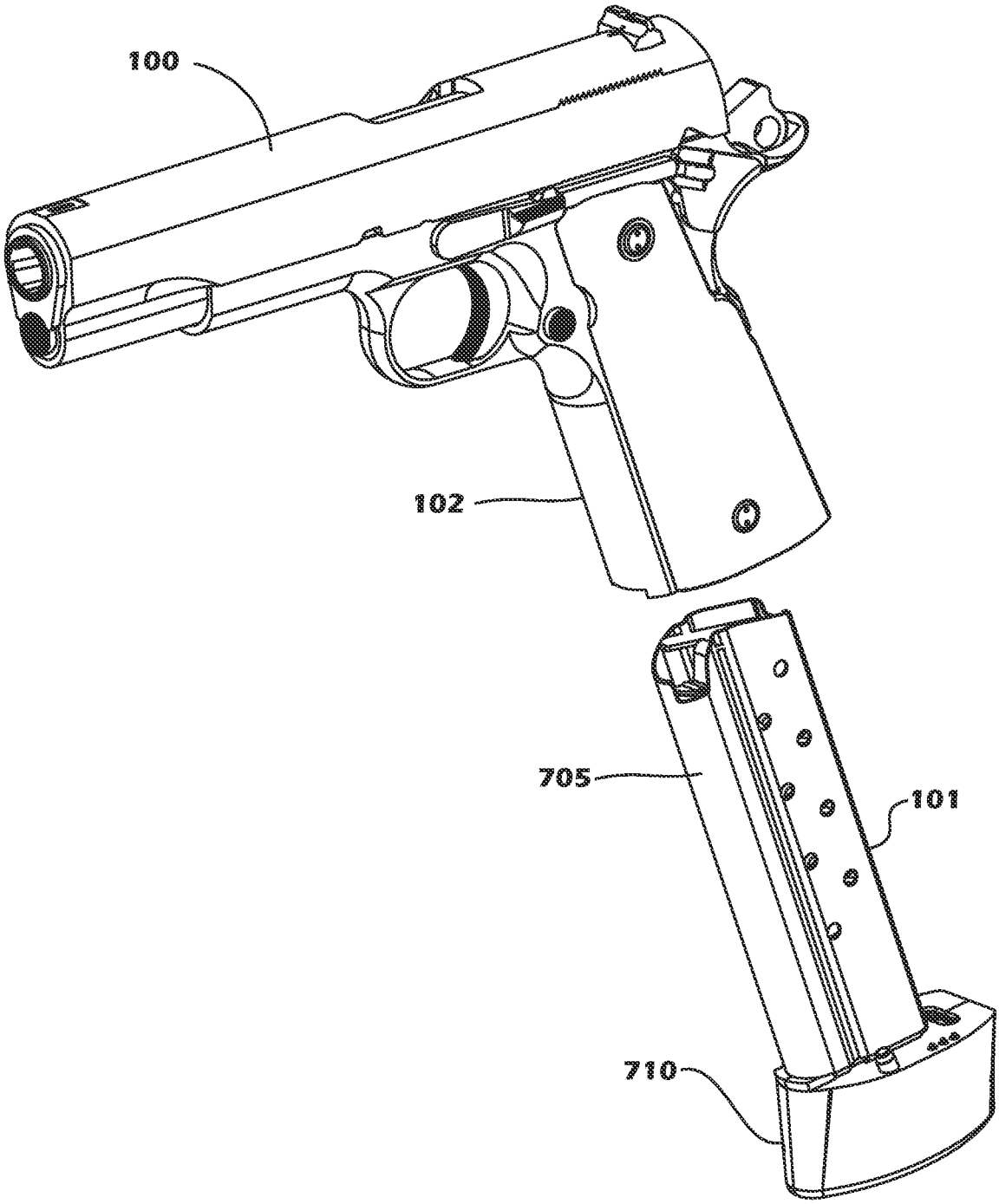
FIG. 7 is a top, front, and left-side perspective view of an ECSS-equipped firearm wherein the magazine and integrated battery pack module is not inserted into the magazine well (not shown in FIG. 7) of the ECSS-equipped firearm, according to an embodiment.

FIG. 7 is a top, side, and front perspective exploded view of an ECSS-equipped firearm 100 wherein the magazine and battery pack module 101 is not inserted into the pistol grip 102 of the ECSS-equipped firearm 100, according to an embodiment. This view allows the modification of the magazine section 705 comprising the ECSS to be understood relative to that of an unmodified firearm. Specifically, the magazine and battery pack module 101 can be comprised of a magazine section 705, designed to hold a predetermined number of rounds of ammunition (not shown in FIG. 7), which can be similar to those used with standard firearms, connected to battery pack section 710 capable of providing a voltage range of 3.7V to 5V, according to an embodiment. According to an embodiment, the battery pack section 710 can comprise a rechargeable battery, such as a lithium-ion battery.

Figure 8:
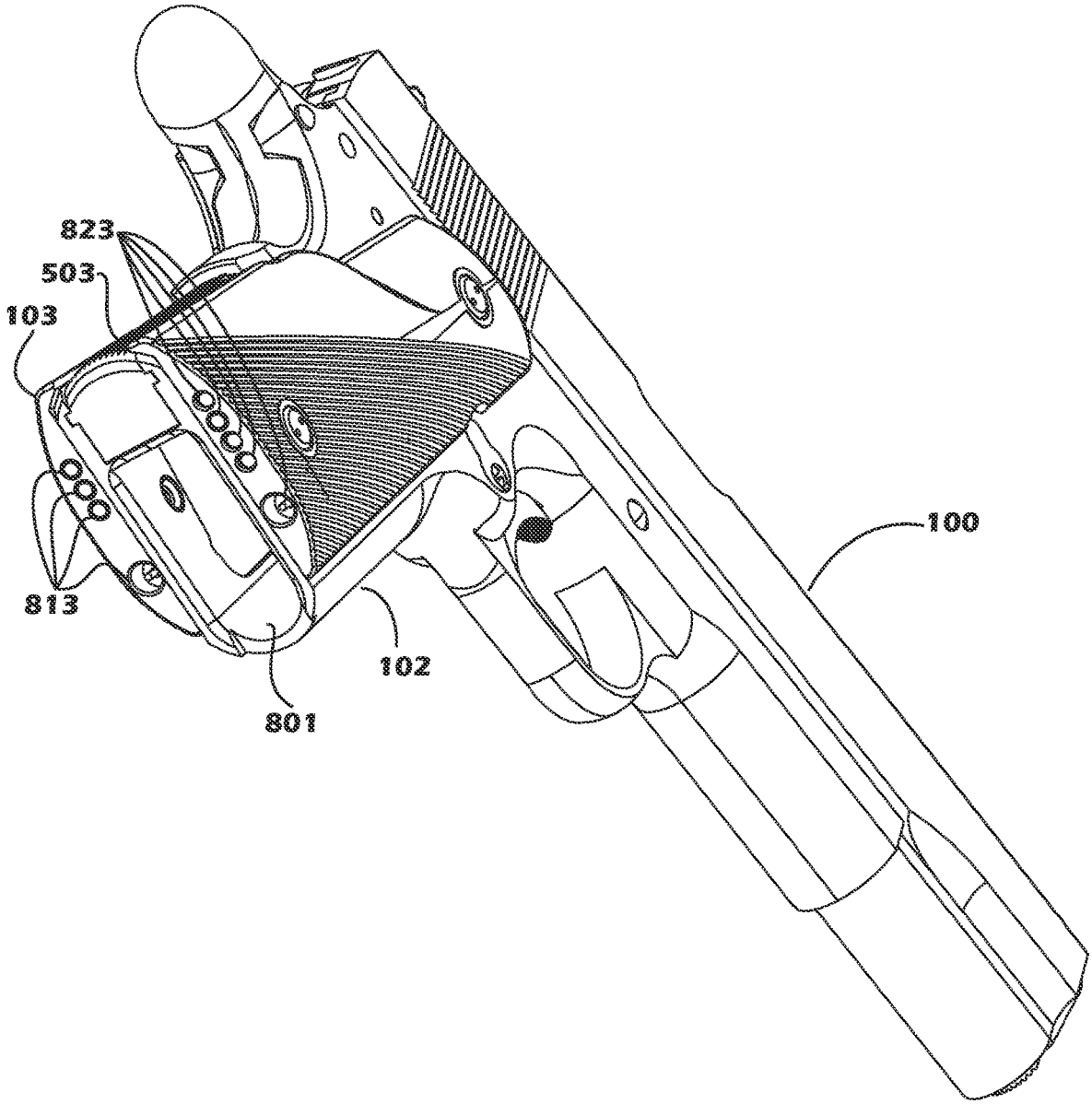
FIG. 8 is a bottom, rear, and right-side perspective view of an ECSS-equipped firearm showing the magazine well wherein a magazine and integrated battery pack module (not shown in FIG. 8) can be inserted into the ECSS-equipped firearm, according to an embodiment.

FIG. 8 is a bottom, side, and rear perspective view of the pistol grip 102 comprising an ECSS-equipped firearm 100 showing the magazine well 801 wherein the magazine and battery pack module 101 (not shown in FIG. 8) can be inserted into the ECSS-equipped firearm 100, according to an embodiment. As mentioned above, nearly all of the electronic components comprising the ECSS can be housed within the left grip panel 103, which can also be referred to as a first or second grip panel, and the right grip panel 503, which can also be referred to as a first or second grip panel and the component can be interchangeably installed in either the left grip panel 103 or right grip panel 503 so long as the grip panel comprising the SMA module 200 (not shown in FIG. 8) is on the same side as the shuttle 210 (not shown in FIG. 8). In this way an ECSS-equipped firearm 100 can be configured for use by either a right-handed or left-handed user. According to an embodiment, the current required to operate these components can pass from the magazine and battery pack module 101 (not shown in FIG. 8) through electrodes (813 and 823) located on the bottoms of each grip panel 103 and 503. According to an embodiment, left-side grip electrodes 813 can be located on the bottom of the left grip panel 103 and right-side electrodes 823 can be located on the bottom of the right grip panel 503. These sets of electrodes, 813 and 823, can carry current, signal, and ground connections from the magazine and battery pack module 101 sufficient to operate the other modules comprising the ECSS as well as to operate a battery level indicator. According to an embodiment, the electrodes 813 and 823 can also be configured to indicate whether the proper magazine and battery pack module 101 is being used with the ECSS-equipped firearm 100 rather than a standard magazine or some other unauthorized magazine and battery pack module.

Figure 9:
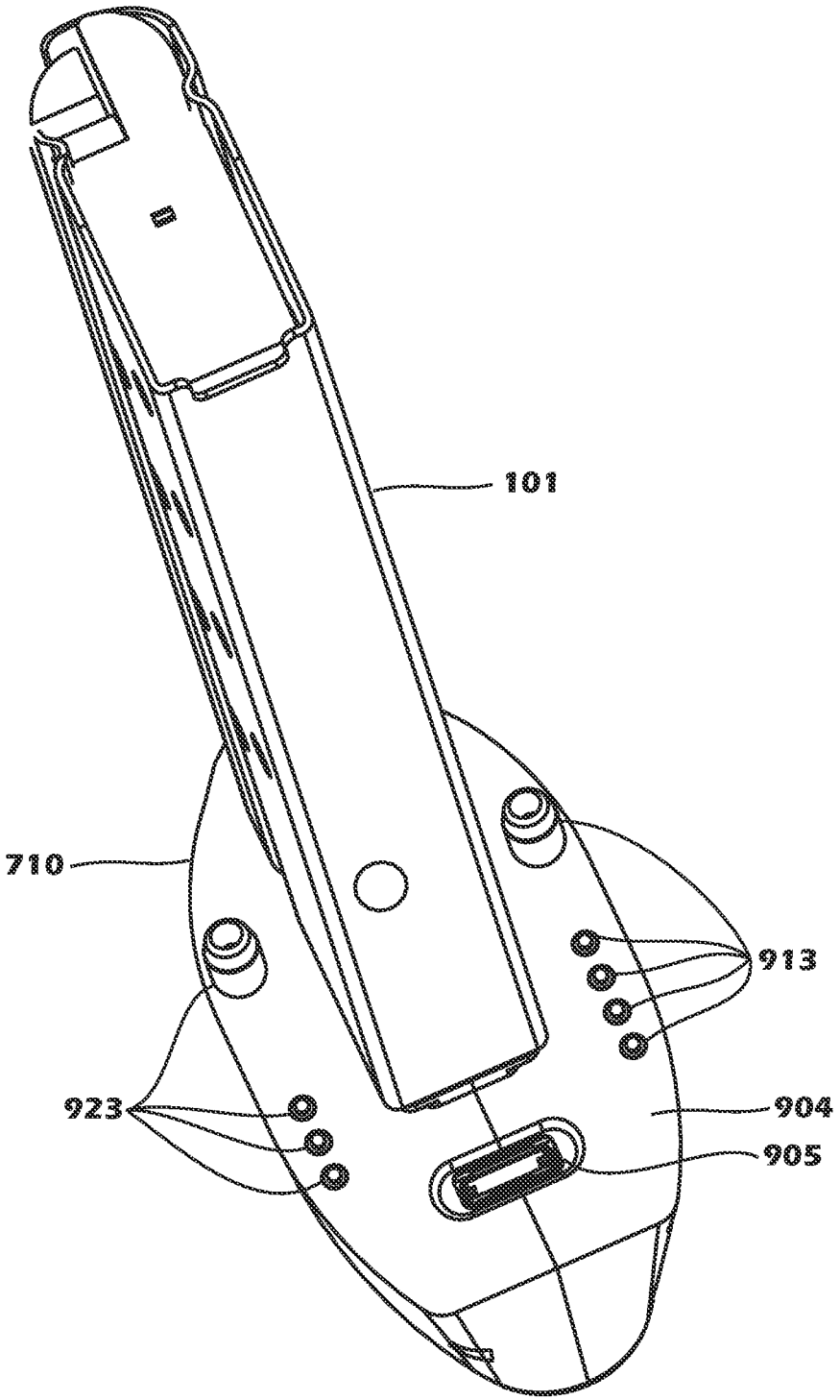
FIG. 9 is a top, front, and right-side perspective view of a magazine and integrated battery module for use in an ECSS-equipped firearm, according to an embodiment.

FIG. 9 is a top, front, and side perspective view of a magazine and battery pack module 101 for use in an ECSS-equipped firearm 100 (not shown in FIG. 9), according to an embodiment. According to an embodiment, left-side clip electrodes 913 can be located on a top section 904 of the battery pack section 710 so as to align with the left-side grip electrodes 813 located on the bottom of the left grip panel 103, as shown in FIG. 8. Likewise, the right-side clip electrodes 923 on the top section 904 of the battery pack section 710 so as to align with the right-side grip electrodes 823 located on the bottom of the right grip panel 503, as shown in FIG. 8. In this embodiment, a charging port 905, can be located on the battery pack section 710 and can be used to recharge the battery pack section 710 as necessary. As stated above, the present ECSS-equipped firearm 100 (not shown in FIG. 9) can be configured so as not to fire when insufficient electrical current is provided to the SMA module 200 (not shown in FIG. 9) and other components because the default position of the SMA module 200 is the safe position as shown in FIG. 3A. Therefore, according to an embodiment, it would also not be possible to fire the present ECSS-equipped firearm 100 if a standard magazine (not shown) were to be inserted into the magazine well 801 (not shown in FIG. 9) instead of a magazine and battery pack module 101, because the standard magazine would not provide the requisite electrical current.

Figure 10:
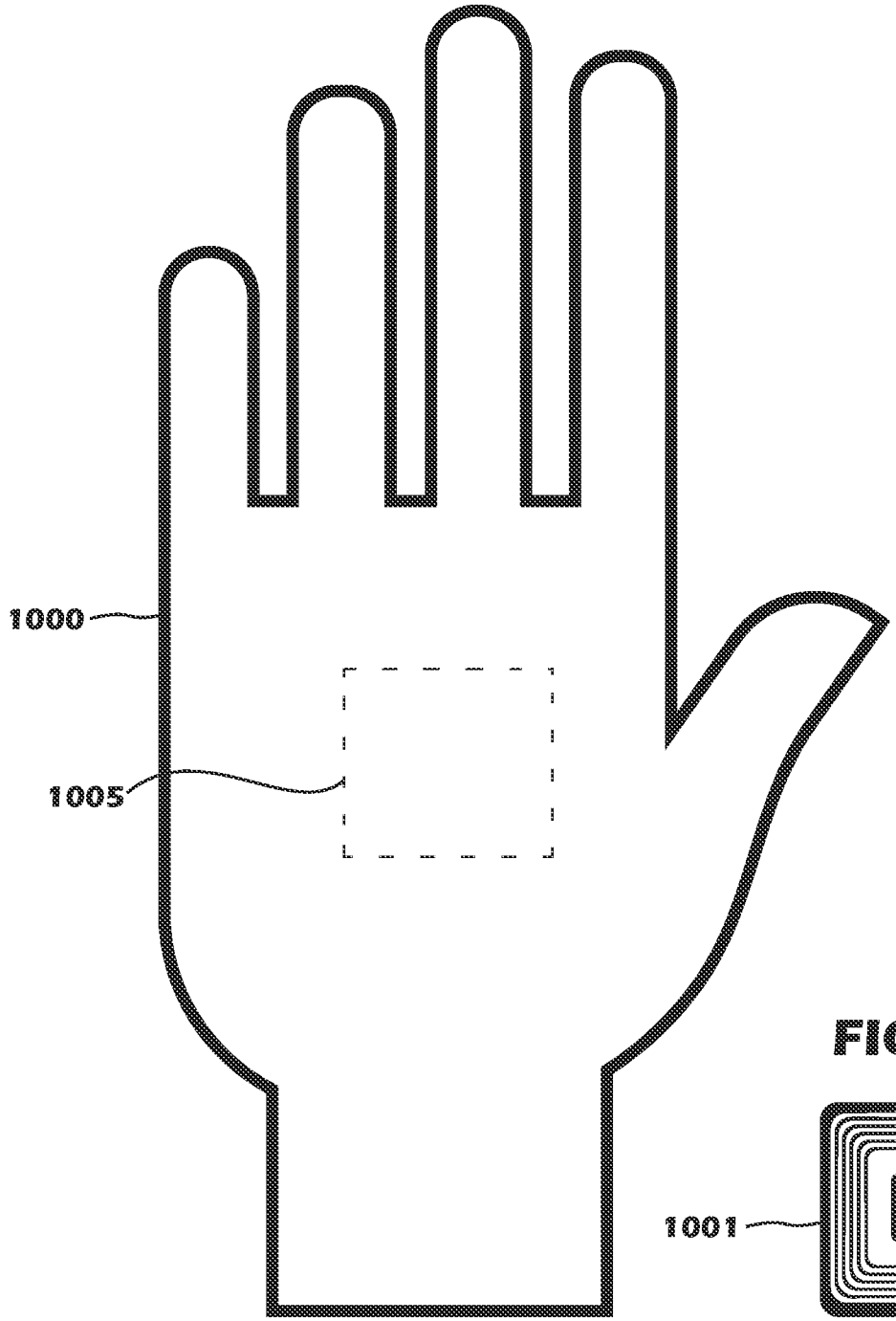
FIG. 10 is a representational view of the inner side of a glove comprising an RFID tag mounted on or within the glove, wherein the position of the RFID tag (not shown in FIG. 10) has been identified with a dotted-line rectangle, according to an embodiment.
Figure 10A:
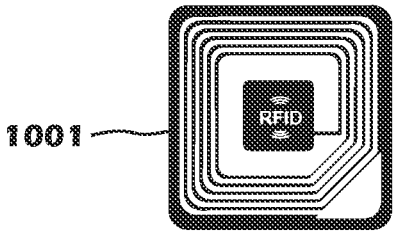
FIG. 10A is a side view of an RFID tag, such as one that could be mounted on or within the glove depicted in FIG. 10, according to an embodiment.

FIG. 10 is a representational view of the inner side of a glove 1000 comprising an RFID tag 1001 (not shown in FIG. 10) mounted on or within the glove 1000, wherein the approximate position of the RFID tag 1001 has been identified with a dotted-line rectangle 1005, and FIG. 10A is a representational view of an RFID tag 1001, such as one that could be mounted on or within the glove 1000 depicted in FIG. 10, according to an embodiment. In the present embodiment, the RFID module 501 (not shown in FIG. 10) could emit an interrogation signal, which could then induce the RFID tag 1001 to emit a signal comprising a predetermined identification number which can be detected by the RFID antenna 505 (not shown in FIG. 10). According to an embodiment, the RFID tag 1001 may be required to be within a range of 0.5 cm to 15 cm in order to be powerful enough to energize the RFID tag 1001 and receive its predetermined identification number via the RFID antenna 505 (not shown in FIGS. 10 thru 10C).

Figure 10B:
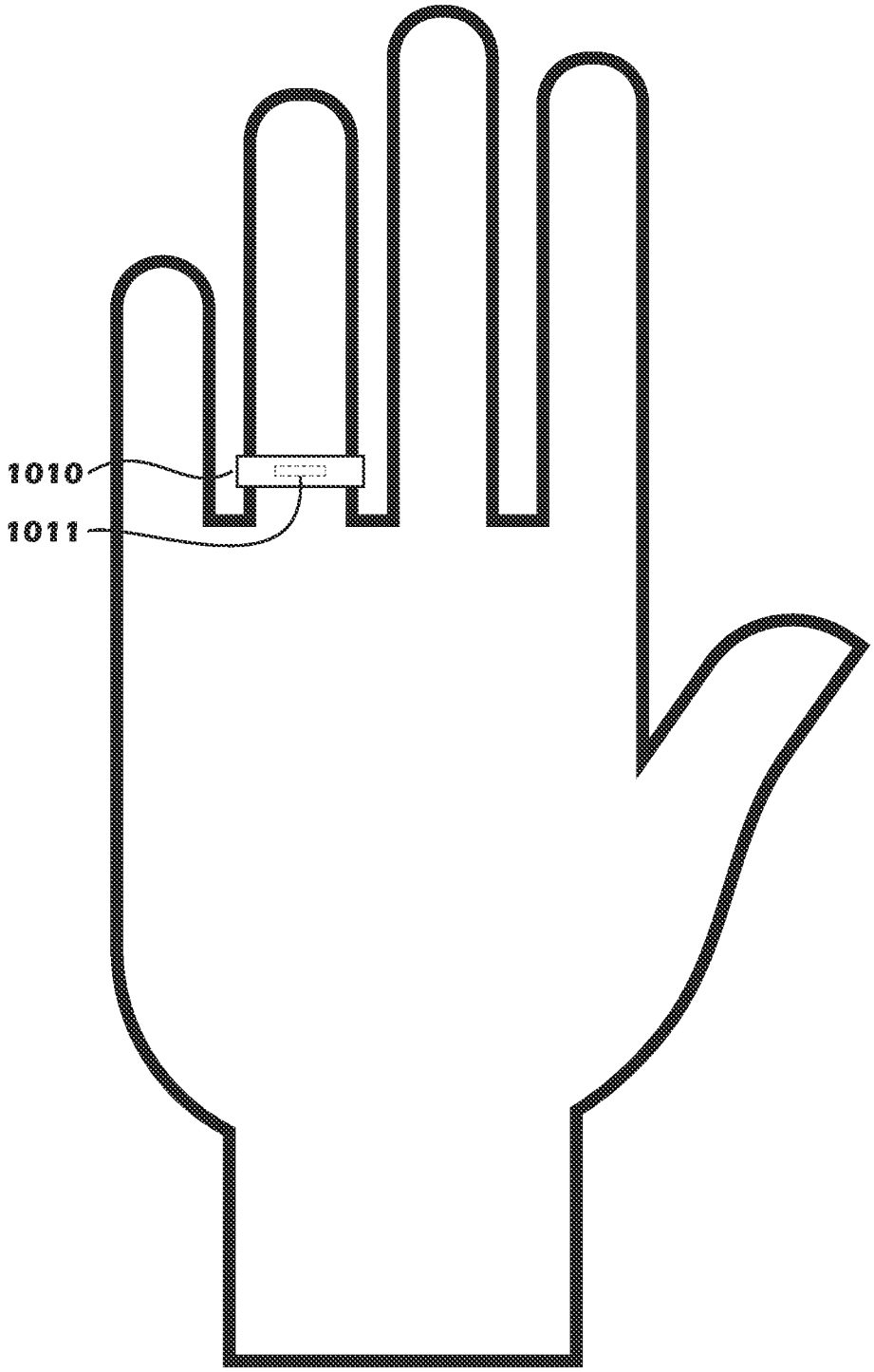
FIG. 10B is a representational view of a hand wearing a ring comprising an RFID tag mounted on or within the ring, wherein the position of the RFID tag (not shown in FIG. 10B) has been identified with a dotted-line rectangle, according to an embodiment.
Figure 10C:
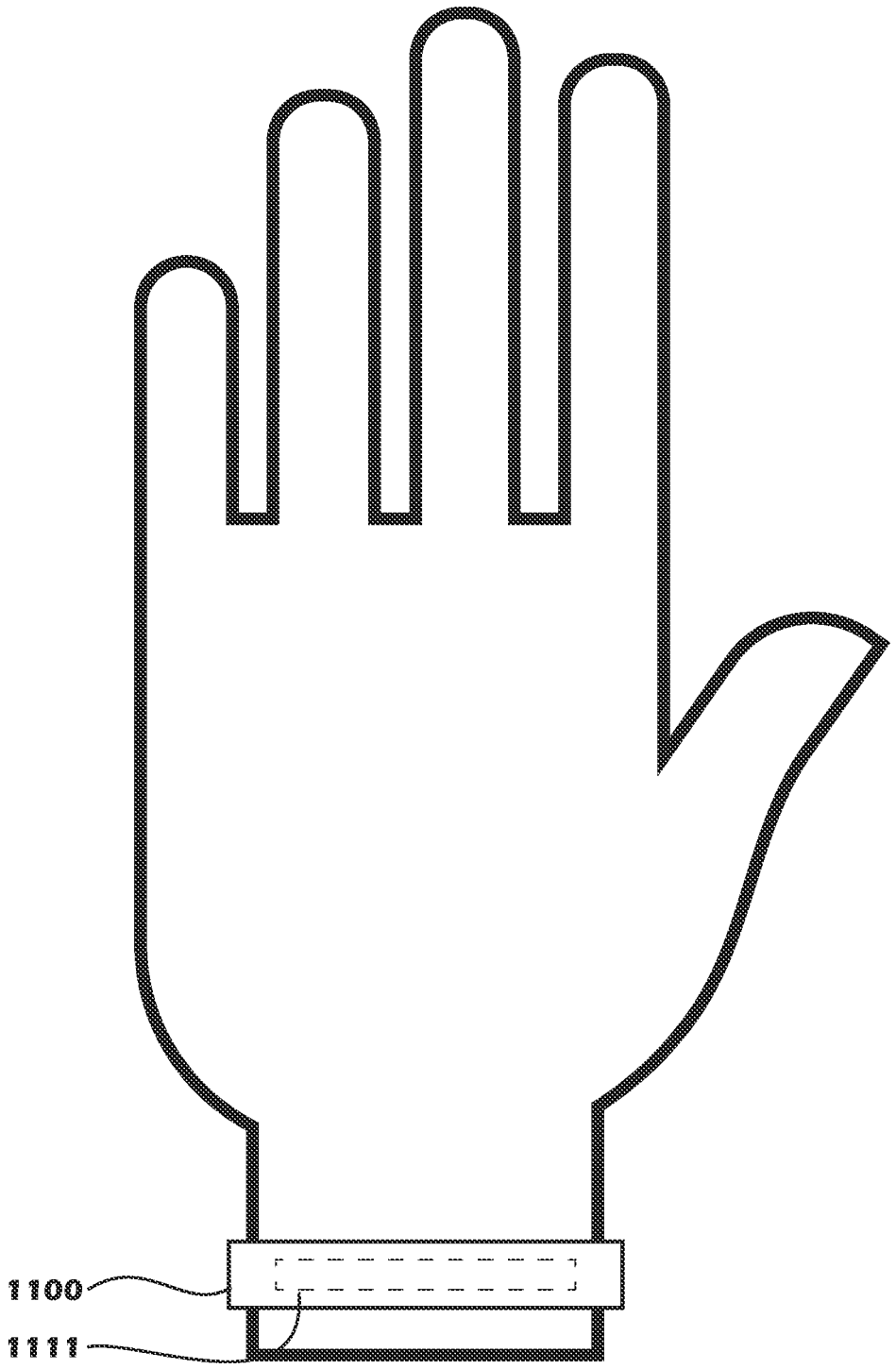
FIG. 10C is a representational view of a hand wearing a bracelet comprising an RFID tag mounted on or within the bracelet, wherein the position of the RFID tag (not shown in FIG. 10B) has been identified with a dotted-line rectangle, according to an embodiment.

FIG. 10B is a representational view of a ring 1010 comprising an RFID tag (not shown in FIG. 10B) mounted on or within the ring 1010, wherein the approximate position of the RFID tag 1001 has been identified with a dotted-line rectangle 1011, according to an embodiment. Similarly, FIG. 10C is a representational view of a bracelet 1100 comprising an RFID tag 1001 (not shown in FIG. 10C) mounted on or within the bracelet 1100, wherein the approximate position of the RFID tag 1001 has been identified with a dotted-line rectangle 1111, according to an embodiment.

Figure 11:
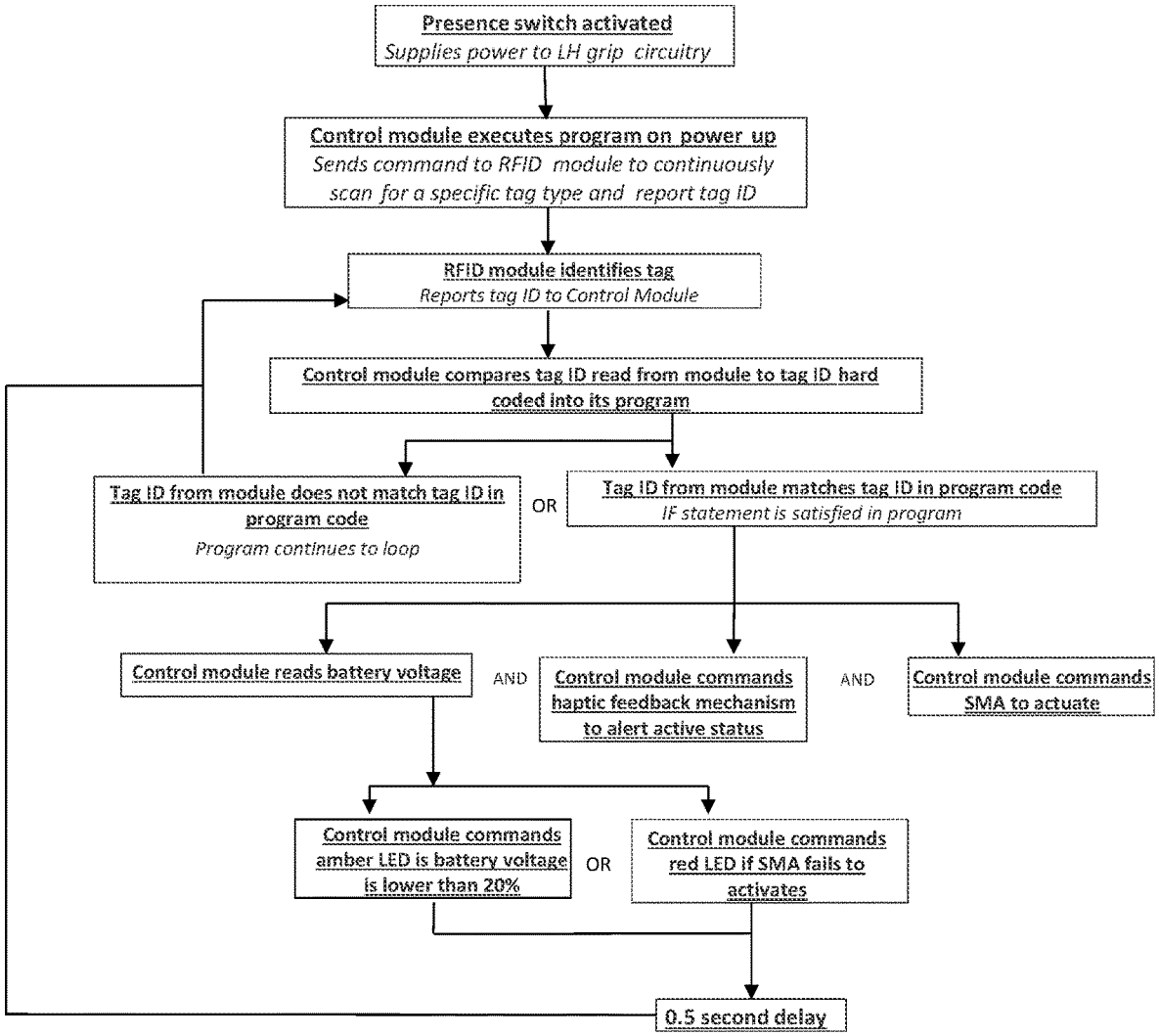
FIG. 11 is an electrical circuit flow chart of a method for using an ECSS, according to an embodiment.

FIG. 11 is an electrical circuit flow chart describing a sequence of processes that can occur in a properly functioning ECSS-equipped firearm 100, according to an embodiment. According to an embodiment, step one can be a power up step wherein power is supplied to the RFID module 501 and the control module 502. Once completed, if the presence switch 805 can be activated by a user, an electric current can be supplied to the SMA module 200 and its circuitry. However, no electrical current can be supplied to the SMA module 200 and its circuitry if the presence switch 805 is not activated, according to an embodiment, which can be a feature designed to prevent the battery 710 charge from being drained unnecessarily. Once the presence switch 805 is activated, and the control module 502 is powered up, the control module 502 can run a program to detect a predetermined RFID tag 1001 through continuous or periodic communication with the RFID module 501 by emitting an interrogation signal, according to an embodiment. The RFID module 501 can then communicate all detected RFID tags 1001 to the control module 502, which can compare each detected RFID tag to the activation tag preprogramed into the control module 502. According to an embodiment, the control module 502 can have multiple RFID tags programmed in for acceptance as the activation tag or only a single RFID tag 1001 programmed in for acceptance. If the detected RFID tag does not match the activation tag (or tags) programed into the control module 502 it will not send a signal to activate the SMA module 200 and continue to compare detected RFID tags to the programmed activation tag. However, if the detected RFID matches the activation tag programed into the control module 502 it can activate the SMA module 200 to move the stage 201 from the safe position to the armed position, also referred to as "active status," according to an embodiment. In an alternative embodiment, the control module 502 can measure the battery voltage of the magazine and battery module 101 to determine if it is within a predetermined range suitable for operation and only allow an electrical current to flow to the SMA module 200 if the voltage is within a predetermined range. According to an embodiment, the control module 502 can drive a first signal to an indicator light 508, or a vibration motor 620, if the ECSS-equipped firearm 100 is armed and ready to fire. Note that although haptic feedback is described as being provided by a vibration motor 620, that it could be provided by any other suitable haptic signaling device. Additionally, or alternatively, the control module 502 can drive a first signal to an indicator light 508, or a vibration motor 620, if the measured battery voltage of the magazine and battery module 101 is lower than the predetermined range suitable for operation. Furthermore, the control module 502 can drive a second signal to the indicator light 508, or the vibration motor 620, if the measured battery voltage of the magazine and battery module 101 is within the predetermined range suitable for operation. For example, according to an embodiment, the control module 502 can drive no signal to the indicator light 508, or the vibration motor 620, if the measured battery voltage is between one hundred (100) percent and twenty-one (21) percent of that when fully charged, the second signal if the measured battery voltage is between twenty (20) percent and six (6) percent, and a first signal if the measured battery voltage is between five (5) percent and zero (0) percent. According to an embodiment, the first signal can cause the indicator light 508 to glow red or the vibration motor 620 to vibrate at a first frequency. In an alternative embodiment, the first signal can cause the vibration motor to pulse in a predetermined way. According to an embodiment, the second signal can cause the indicator light 508 to glow amber or the vibration motor 620 to vibrate at a second frequency. In an alternative embodiment, the second signal may cause the vibration motor 620 to pulse in a predetermined way.

Figure 12:
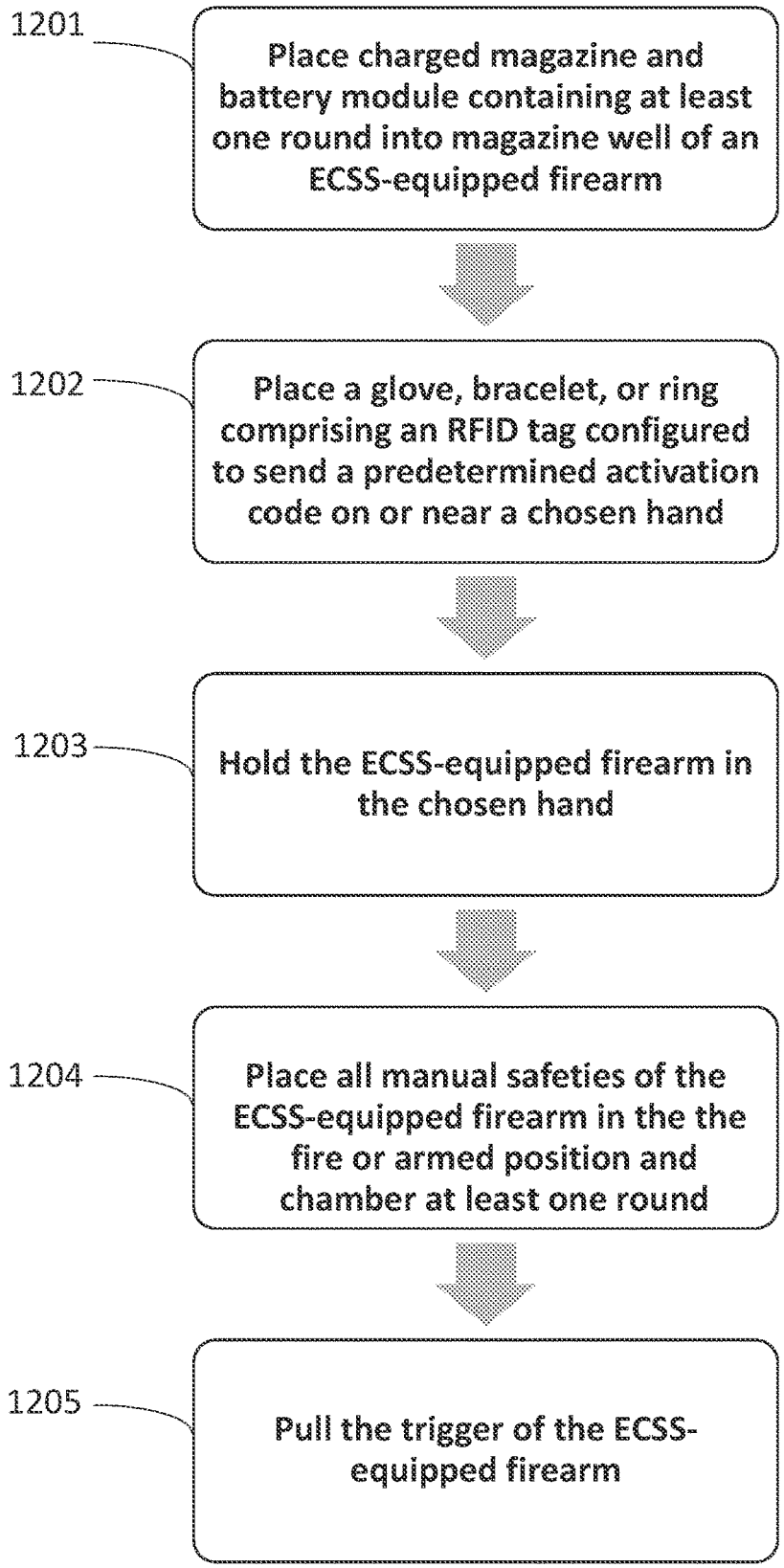
FIG. 12 is a flowchart describing a method for a user to operate an ECSS-equipped firearm, according to an embodiment.

FIG. 12 is a flowchart for a method for a user to fire an ECSS-equipped firearm 100 according to an embodiment. According to an embodiment, a first step 1201 of firing an ECSS-equipped firearm 100 can be to place a magazine and battery module 101 having a battery voltage within a predetermined range and containing at least one round of suitable ammunition into the magazine well 801 of the ECSS-equipped firearm 100 and chambering at least one round of suitable ammunition. Note that the round can be chambered in a later step, but must be performed before the trigger is pulled. Step two 1202, according to an embodiment, can be to place a glove, ring, or bracelet comprising an RFID tag having a predetermined frequency on or near a user's hand that will hold the ECSS-equipped firearm 100 and pull the trigger 107 of the of the ECSS-equipped firearm 100. According to an embodiment, step three 1203 can be to hold the ECSS-equipped firearm 100 in the user's hand wearing the glove, ring, or bracelet, which further comprises the RFID tag having a predetermined frequency. In an alternative embodiment, holding the ECSS-equipped firearm 100 in the user's hand can also activate a presence switch 805. In step four, the user can then move one or more manual safeties 108 and 109 of the ECSS-equipped firearm 100 from safe to fire as step four 1204, according to an embodiment. The round can be chambered in Step 4 according to an alternative embodiment. Lastly, in step five, the user can pull the trigger 107 to fire at least one round from the ECSS-equipped firearm 100, according to an embodiment.

Although the present apparatus has been described in terms of exemplary embodiments, it is not limited thereto. Rather, the appended claims should be construed broadly, to include other variants and embodiments, which may be made by those skilled in the art without departing from the scope and range of equivalents of the disclosed apparatus.

What is claimed is:

1. An electronically controlled safety system for use in firearms comprising:

a trigger mechanism interface connected to, or otherwise incorporated into a firearm's trigger mechanism wherein the trigger mechanism interface comprises a point of connection;

a shape memory actuator module comprising at least one shape memory wire and a mechanical locking interface actuated by at least one shape memory wire wherein the mechanical locking interface is designed to connect to the point of connection of the trigger mechanism interface and immobilize the trigger mechanism when the mechanical locking interface is connected to the point of connection of the trigger mechanism;

a radio frequency identification module comprising a radio frequency identification reader configured to send a radio frequency interrogation signal and to receive a predetermined activation code;

a radio frequency identification tag configured to transmit the predetermined activation code when subjected to the radio frequency identification reader's interrogation signal received at or above a predetermined signal strength;

a control module configured to allow a current to flow to the shape memory actuator module when the radio frequency identification reader receives the predetermined activation code; and a magazine and battery module configured to provide an electrical current to the shape memory actuator module, the radio frequency identification module, and the control module wherein the control module is configured to activate a vibration motor when the firearm is armed and ready to fire.

2. The electronically controlled safety system for use in firearms as described in claim 1 wherein the control module measures battery voltage of the magazine and battery module to determine if it is within a predetermined range suitable for operation.

3. The electronically controlled safety system for use in firearms as described in claim 2 wherein the control module measures battery voltage of the magazine and battery module to determine if it is within a predetermined range suitable for operation and the control module sends a first signal to the vibration motor if the measured battery voltage of the magazine and battery module is lower than the predetermined range required for operation.

4. The electronically controlled safety system for use in firearms as described in claim 3 wherein the vibration motor vibrates at a first frequency when the control module sends the first signal to the vibration motor.

5. The electronically controlled safety system for use in firearms as described in claim 3 wherein the vibration motor pulses in a predetermined pattern when the control module sends the first signal to the vibration motor.

6. The electronically controlled safety system for use in firearms as described in claim 2 wherein the control module measures battery voltage of the magazine and battery module to determine if it is within a predetermined range suitable for operation and the control module sends a first signal to an indicator light if the measured battery voltage of the magazine and battery module is lower than the predetermined range required for operation.

7. The electronically controlled safety system for use in firearms as described in claim 6 wherein the vibration motor vibrates at a second frequency when the control module sends the second signal to the vibration motor.

8. The electronically controlled safety system for use in firearms as described in claim 6 wherein the vibration motor pulses in a predetermined pattern when the control module sends the second signal to the vibration motor.

9. The electronically controlled safety system for use in firearms as described in claim 1 wherein the radio frequency identification tag is located in a glove.

10. The electronically controlled safety system for use in firearms as described in claim 1 wherein the radio frequency identification tag is located in a bracelet.

11. The electronically controlled safety system for use in firearms as described in claim 1 wherein the radio frequency identification tag is located in a ring.

12. The electronically controlled safety system for use in firearms as described in claim 1 wherein the control module only allows current to flow to the shape memory actuator when a presence switch is activated.

13. The electronically controlled safety system for use in firearms as described in claim 1 wherein the vibration created by the vibration motor is configured to be adjustable.

14. A method for using an ECSS-equipped firearm, the method comprising:

Providing an ECSS-equipped firearm comprising a trigger mechanism interface connected to, or otherwise incorporated into a firearm's trigger mechanism wherein the trigger mechanism interface comprises a point of connection; a shape memory actuator module comprising at least one shape memory wire and a mechanical locking interface actuated by at least one shape memory wire wherein the mechanical locking interface is designed to connect to the point of connection of the trigger mechanism interface and immobilize the trigger mechanism when the mechanical locking interface is connected to the point of connection of the trigger mechanism interface; a radio frequency identification module comprising a radio frequency identification reader configured to send a radio frequency interrogation signal and to receive a predetermined activation code; a radio frequency identification tag configured to transmit the predetermined activation code when subjected to the radio frequency identification reader's interrogation signal received at or above a predetermined signal strength; a control module configured to allow a current to flow to the shape memory actuator module when the radio frequency identification reader receives the predetermined activation code; and a magazine and battery module configured to provide an electrical current to the shape memory actuator module, the radio frequency identification module, and the control module wherein the control module is configured to activate a vibration motor when the firearm is armed and ready to fire;

Providing at least one round of suitable ammunition;

Placing the at least one round of suitable ammunition in the magazine;

Placing the magazine in the magazine well and loading the round of suitable ammunition into the chamber;

Placing the radio frequency identification tag near the ECSS-equipped firearm; and Pulling the trigger of the ECSS-equipped firearm.

15. The method for using an ECSS-equipped firearm as described in claim 14 wherein the control module measures battery voltage of the magazine and battery module to determine if it is within a predetermined range suitable for operation.

16. The method for using an ECSS-equipped firearm as described in claim 15 wherein the control module measures battery voltage of the magazine and battery module to determine if it is within a predetermined range suitable for operation and the control module sends a first signal to the vibration motor if the measured battery voltage of the magazine and battery module is lower than the predetermined range required for operation.

17. The method for using an ECSS-equipped firearm as described in claim 16 wherein the vibration motor vibrates at a first frequency when the control module sends the first signal to the vibration motor.

18. The method for using an ECSS-equipped firearm as described in claim 16 wherein the vibration motor pulses in a predetermined pattern when the control module sends the first signal to the vibration motor.

19. The method for using an ECSS-equipped firearm as described in claim 14 wherein the control module measures battery voltage of the magazine and battery module to determine if it is within a predetermined range suitable for operation and the control module sends a first signal to an indicator light if the measured battery voltage of the magazine and battery module is lower than the predetermined range required for operation.

20. The method for using an ECSS-equipped firearm as described in claim 19 wherein the vibration motor vibrates at a second frequency when the control module sends the second signal to the vibration motor.

* * * * *